United States Patent [19]

Lessi

[11] Patent Number: 4,942,926

[45] Date of Patent: Jul. 24, 1990

[54] DEVICE AND METHOD FOR CARRYING OUT OPERATIONS AND/OR MANIPULATIONS IN A WELL

[75] Inventor: Jacques Lessi, Maule, France

[73] Assignee: Institut Francais du Petrole, Rueil Malmaison, France

[21] Appl. No.: 302,333

[22] Filed: Jan. 27, 1989

[30] Foreign Application Priority Data

Jan. 29, 1988 [FR] France ..... 88 01089

[51] Int. Cl.[5] ..... E21B 23/00; E21B 43/12; E21B 43/14

[52] U.S. Cl. ..... 166/385; 166/50; 166/66.4; 166/250; 166/369; 166/375

[58] Field of Search ..... 166/65.1, 66, 66.4, 166/250, 385, 77, 297; 175/4.55, 40, 45, 61, 62

[56] References Cited

U.S. PATENT DOCUMENTS

| | | | |
|---|---|---|---|
| 4,457,370 | 7/1984 | Wittrisch | 166/64.1 X |
| 4,574,892 | 3/1986 | Grigar et al. | 166/385 X |
| 4,690,214 | 9/1987 | Wittrisch | 166/65.1 X |
| 4,753,291 | 6/1988 | Smith et al. | 166/65.1 |
| 4,759,406 | 7/1988 | Smith et al. | 166/65.1 |
| 4,767,349 | 8/1988 | Pottier et al. | 166/65.1 X |

*Primary Examiner*—Stephen J. Novosad
*Attorney, Agent, or Firm*—Antonelli, Terry, Stout & Kraus

[57] ABSTRACT

A method and device for carrying out operations and/or manipulations in a well which has a casing with the well being and drilled in geological formations having at least two distinct zones.

The device according to the invention is characterized in particular by casing (3) having, in its interior, a first connector (10) usable in a liquid medium, the first connector being connected by lines (40) to at least one instrument and/or tool (11, 14, 16, 18, 34, 35, 36, 37) disposed in each of zones (30, 31, 32, 33), the first connector (10) being designed to cooperate with a second connector (21) connected by a transmission cable (22) to the surface of the ground, casing (3) being designed to permit the second connector to be lowered from the surface and connect with the first connector. The casing has, in an interior thereof, a first connector usable in a liquid medium, with the first connector being connected by lines to at least one instrument and/or two disposed in each of the zones. The first connector is adapted to cooperate with a second connector connected by a transmission cable to the surface of the ground. The casing is constructed such that the second connector may be lowered from the surface and connected with the first connector. The device is suitable for measurements and/or manipulations carried out in a well drilled into the ground when fluids from geological formation such as oil-bearing and gas-bearing formations are being exploited.

22 Claims, 2 Drawing Sheets

DEVICE AND METHOD FOR CARRYING OUT OPERATIONS AND/OR MANIPULATIONS IN A WELL

BACKGROUND OF THE INVENTION

The present invention relates to a method and a device for carrying out operations and/or manipulations in a well drilled into oil-bearing or gas-bearing geological formations, in particular a horizontal well.

The invention applies in particular to exploitation in stages of geological formations, and permits the flowrate, temperature, pressure, etc. measurements that may be made on the effluents from each producing formation.

For this type of application, the invention is particularly advantageous because of the speed of implementation of the device and method according to the invention, since it does not exclude certain types of work, such as those using the so-called wire line technique, that one may be called upon to use during production.

The invention also allows downhole tools to be controlled, which tools may be, for example, valves controlling selective production from a geological formation.

The controls of the tools or measurements with the method or device according to the invention are particularly advantageous because of the speed of their implementation (via the inside of the casing) and the full opportunities for manipulating the casing (rotation, advance, disassembly, etc.) which are unhampered by fixed or peripheral lines such as those currently used.

The invention applies advantageously to production by horizontal wells. Particularly in oil drilling, production by a well causes displacement of the various layers of liquids in the producing zone, a phenomenon called coning. In production in horizontal wells, undesirable fluids such as water generally arrive irregularly along the well so that a large portion of the liquid sought, such as oil, is not extracted from the formations.

There are two approaches to overcoming this drawback, for example, several producing zones are created and equipped with means such as valves that allow the flowrate to be controlled; and the quality and quantity of the fluids coming from each of the producing zones are controlled. This control may be effected by instruments such as flowmeters and physical and/or chemical instruments for measuring fluids, disposed, for example, along the well or casing according to each of the producing zones.

The invention furnishes a method for carrying out operations and/or manipulations such as measurements in a well having a casing with a smaller diameter than that of the well, with the well being drilled into geological formations and having at least two distinct producing zones.

In accordance, with the method of the present invention, each of the two zones of the well is equipped with at least one instrument and/or tool designed to perform the operations and/or manipulations, and the casing is equipped with a first connector usable in a liquid medium. The instruments and/or tools are connected to the first connector by lines, with a transmission cable, equipped with a sucking connector designed to connect to the first connector, being introduced into the casing. The second connector is moved until it cooperates with the first connector, and the operations and/or manipulations are carried out by controlling the tools and/or instruments by the transmissions cable.

The tools and/or instruments may, in accordance with the present invention, may be integral with the casing, and the distinct zones may be fluid-producing zones.

At least one of the instruments may be designed to measure the physical and/or chemical and/or physicochemical characteristics of the fluids present in a producing zone. At least one of the tools may be designed to modify fluids in the producing zone.

The first connector may be disposed at the lower end of the casing.

When the zones are producing zones, the fluids produced by these producing zones may be transferred inside the casing, and the casing may be equipped with means for allowing selective production from the well.

When the first connector is disposed at the lower end of the casing, a pipe designed to communicate with the lower end of the casing by a hydraulic connector and/or a passageway may be disposed at the lower end of the casing, this connector and this passageway being located above and/or below the level of the first connector.

The invention also provides a device for conducting operations and/or manipulations such as measurements in a well having a casing, with the casing having a smaller diameter than a diameter of the well being drilled into geological formations and having at least two distinct zones. The device also has in its interior a first connector usable in a liquid medium, with the first connector being connected by lines to at least one instrument and/or tool disposed in each of the zones. The first connector is designed to cooperate with a second connector connected by a transmission cable to the surface of the ground with the casing being designed to allow the second connector to be lowered from the surface and connected with the first connector.

When the zones are fluid-producing zones, the casing may hold the tools and/or instruments.

When the zones are fluid-producing zones and the casing has means allowing these zones to communicate with the inside of the casing, these means may allow selective production from the well.

The first connector may be disposed at the lower end of the casing.

The device may include a pipe communicating with the casing essentially at the level of the first connector and terminating at the surface of the ground.

BRIEF DESCRIPTION OF THE DRAWINGS

The present invention will be thoroughly understood and all of its advantages will emerge clearly from a reading of the description when taken in connection with the accompanying drawings which show, for the purpose of illustration only, one embodiment in accordance with the present invention, and wherein.

DETAILED DESCRIPTION

Figure 1:
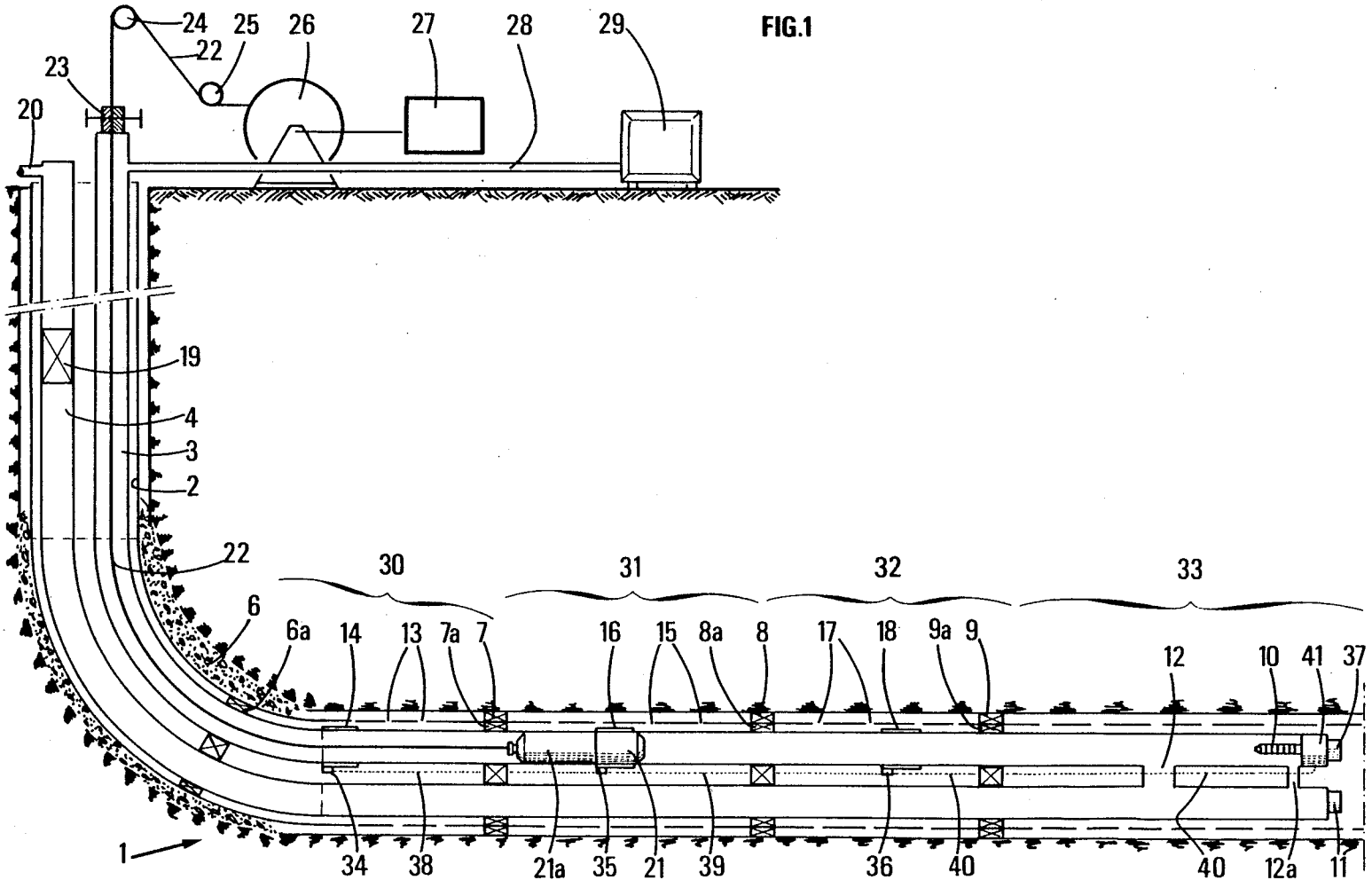
FIG. 1 is a cross-sectional view through a well-equipped with a device according to the invention during a stage proceeding connection.

In FIg. 1, the well generally designated by the reference numeral 1 has a portion that is sharply tilted to the vertical or even horizontal, and equipped with a device according to the invention, is operated from the surface of the ground. The well 1 has, for a certain length, a casing string 2 inside which is a casing 3 and a pipe 4, which traverses the geological formations from which fluids are to be produced.

In order selectively to produce fluids from the geological formations according to producing zones 30, 31, 32, 33, sealing means 7, 8, 9 of the packer type are disposed between casing string 2 and the formations and internal sealing means 6a, 7a, 8a, 9a inside the casing string 2 are disposed between casing string 2 and the first casing 3 and pipe 4, with the internal sealing means 6a, 7a, 8a, 9a being located essentially at right angles to sealing means 7, 8, 9, respectively and are of the double packer type, for example.

Each of the producing zones 30, 31, 32 respectively communicates with zones inside casing string 2 via orifices 13, 15, 17. The producing zones 30, 31, 32 can be made to communicate at will with the inside of first casing 3 by means of circulation valves such as sliding jacket valves 14, 16, 18, respectively.

During production the valves 14, 16, 18 are normally provided with check valves preventing fluid circulation from the casing 3 to the formations, but these check valves could be eliminated if, for example, a zone were to be fractured.

The lower end of pipe 4 has a remote-controllable valve 11 such as a sliding jacket valve similar to valves 14, 16, 18 for allowing a lower part 33 of well 1 to be placed in communication with the casing 3 and the pipe 4, either for producing fluids from the well bottom (via pipe 4) or for the normal operating requirements of the well.

Pipe 4, connected to the casing 3 by hydraulic connecting element 12 may, if needed, have, at the required depth, a circulating pump 19 which draws fluid from the formations and discharges the fluid at the surface of the ground via outlet 20. Pump 19 may be a hydraulic, electric, or mechanical pump such as the plunger of a cup-packed beam pump. The position of the pump 19 in the well may be substantially below the dynamic level of a producing formation. According to the invention, the circulation direction of the pump fluid may be upward and one-way.

The inside and lower end of casing 3 comprises a first connector 10 connected by electrical lines 40 to instruments and/or tools 34, 35, 36, 37 disposed in each of producing zones 30, 31, 32, 33.

This first connector 10 is designed to cooperate with a second connector 21 connected to the surface of the ground by a transmission cable 22. This second connector 21 is introduced into casing 3 at its upper part, then moved to second connector 10 to cause them to cooperate.

Second connector 21 may include a loading bar 21a which allows this second connector 21 to be lowered by gravity, in particular for vertical wells or wells slightly inclined with respect to vertical. The second connector may also have fittings designed to cooperate with the inside of casing 3, in particular for wells that are sharply inclined with respect to vertical or even horizontal or even rising, in order to provide a seal and thus move this connector 21 by hydraulic pumping produced either by station 29 which is connected to casing 3 by a pipe 28, or by the circulating pump 19 located in pipe 4.

The end of the casing 3 has a passageway 12a located below hydraulic connection 12 which permits circulation of fluid, with the hydraulic connection 12 being designed to allow evacuation of mud or other sediment and also being designed to permit elimination of fluid present between first connector 10 and second connector 21, particularly when the connectors 10, 21 are connected, by means of a suitable cross section. Hydraulic connection 12 is also designed to allow absorption of the inertia of second connector 21 during its connection with first connector 10.

To cause second connector 21 to be lowered by hydraulic pumping of a fluid such as a degassed oil, the upper end of casing 3 has a stuffing box 23 through which transmission cable 22 passes before the transmission cable 22 is guided by two pulleys 24, 25 to winch 26 controlled by station 27.

When a well 1 such as a well drilled into geological formations containing hydrocarbons is placed in production, the well 1 is equipped with at least one casing 3 and a pipe 4 for safety reasons, in order to prevent circulation of fluid between casing string 2 and casing 3. Thus, when second connector 21 is moved, the fluid present thereunder rises in pipe 4. It will not be a departure from the scope of the invention, particularly when producing from a well, to connect hydraulic connection 12 to the annular space between casing 3 and casing string 2 by eliminating the pipe 4.

The second connector 21 is connected to measuring instruments 34, 35, 36, 37 located in producing zones 30, 31, 32, 33, respectively, by electrical lines 38, 39, 40, 41. These measuring instruments 34, 35, 36, 37 are designed to measure the flowrate of fluid passing through valves 14, 16, 18, 11, respectively, and the temperature and pressure of the fluids in each of the producing zones 30, 31, 32, 33, respectively. In the same way as the pressure, flowrate, and temperature measurements, any other type of physical and/or chemical and/or physicochemical measurement such as the resistivity of fluids in the producing zones, may be measured. By providing an electrical link between the measuring instruments 34, 35, 36, 37 and the surface, it is possible to obtain, at any moment, a real-time measurement of the characteristics of the fluids in each producing zone 30, 31, 32, 37 and thus establish an optimum production program by manipulating valves 14, 16, 18, 11 in each of the producing zones 30, 31, 32, 33 . For example, if the transmission cable 22 has only one conductor, a multiplexer could be used to combine the information from the measuring instruments 34, 35, 36, 37.

Valves 14, 16, 18 are selectively controlled from the surface of the ground either by wrench-type tools 21a, or by hydraulic control. These wrench-type tools are cable-controlled for vertical or slightly slanting wells, or with hydraulic engines for wells permitting hydraulic circulation according to the TLF (through flow line) technique or any other means such as that described in French Patent Application EN-87/11,749.

Figure 2:
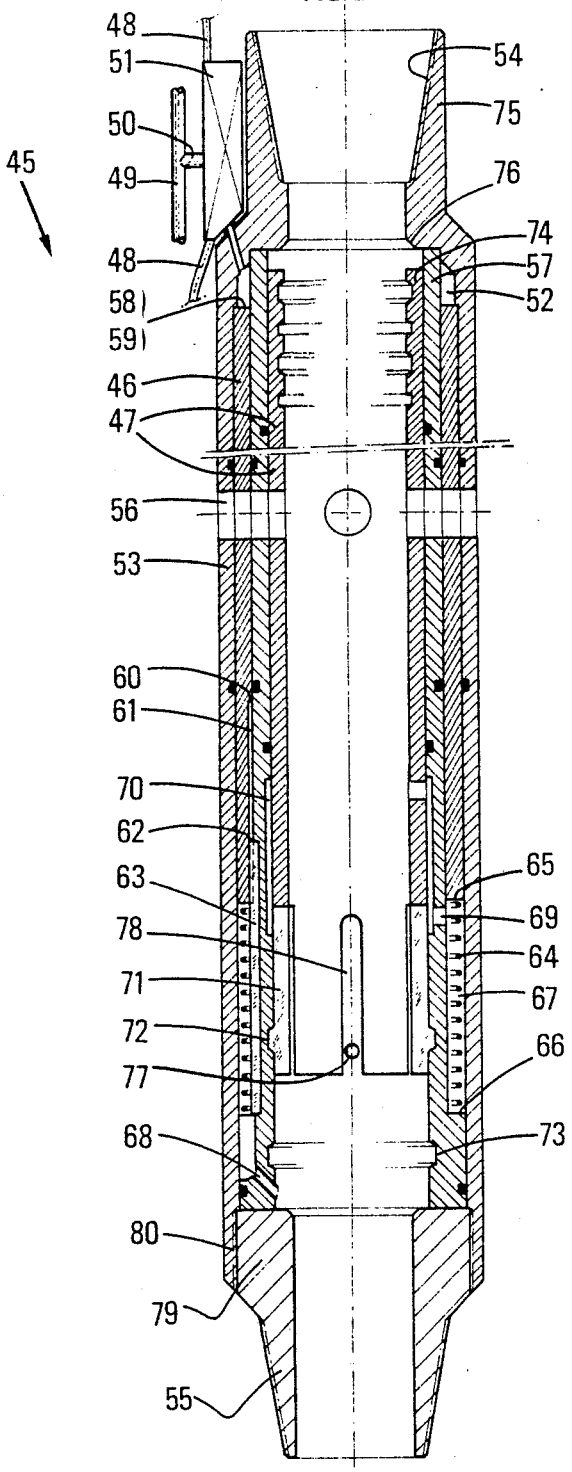
FIG. 2 is a longitudinal cross-sectional view of a selective hydraulic valve with a sliding jacket used in a device according to the present invention.

As shown in FIG. 2 a solenoid-actuated hydraulic valve generally designated by the reference numeral 45 with a sliding hydraulic jacket 46 and safety jacket 47 designed for selective production from a well according to the invention is adapted to place the outside into, and out of, communication with the inside of the casing 3.

A hydraulic line 49, providing the power source of the power elements such as elements similar to valve 45, communicates via a branch 50 with the solenoid valve 45. On this branch 50 are disposed distribution means such as a solenoid valve 51, which are connected by an electrical cable 48 to the first connector 10 located at the lower end of casing 3 (FIG. 1).

This solenoid valve 45 provides, and interrupts, communication between hydraulic line 45 and hydraulic thrust chamber 52 of the hydraulic sliding jacket 46.

The solenoid hydraulic valve 45 has an outer cylindrical body 53 fitted into casing 3 by a conical female connector 54 at the top of the valve 45 and a conical male connector 55 at the bottom thereof.

In this body 53, providing the outer envelope of the solenoid valve 45, are disposed, essentially in the same plane perpendicular to the axis of the casing 3, four closable orifices 56 that alter communication between the inside and outside of the casing 3. The orifices 56 are closed by the sliding hydraulic jacket 46 or safety jacket 47.

An extension 57, separating sliding hydraulic jacket 46 and safety jacket 47, together with the sliding hydraulic jacket 46 and the body 53, defines hydraulic thrust chamber 52, and provides guidance of the hydraulic sliding jacket 46 and the safety jacket 47.

The hydraulic jacket 46 slides between two extreme positions defined by cooperation of an opening stop 58 with upper nipple 59 of the sliding hydraulic jacket 46, and by cooperation of a bead 60 of a groove 61 made in the lower part of the sliding hydraulic jacket 46 with a bead 62 of key 63. Key 63 is integral with the extension 57 and, by cooperating with the groove 61, rotationally positions the sliding hydraulic jacket 46 with respect to the valve body 53.

A return spring 64, cooperating with the lower nipple 65 of the hydraulic jacket 46 and a shoulder 66 of the extension 57, returns hydraulic jacket 46 to the resting position when the pressure inside the hydraulic thrust chamber 52 corresponding to a reservoir designed to contain a variable mass of hydraulic fluid falls below a preset value.

The cylindrical space 67 defined by the shoulder 66, lower nipple 65, body 53, and extension 57, in which the return spring 64 is located, terminates inside the casing 3 by a lower circulation orifice 68 and by an upper circulation orifice 69, a recess 70, and holes made in the safety jacket 47, in order to permit circulation of fluid and prevent the return spring 64 from jamming. Instead of causing this cylindrical space 67 to terminate inside the casing 3, this space 67 may be connected to a compensating chamber filled with a fluid such as, for example, oil that remains clean.

Safety jacket 47 slides inside cylindrical extension 57 between two positions defined by the cooperation of an elastic blade 71 having a projection with two inner annular grooves 72, 73 machined into extension 57 and allocating to the safety jacket 47 an upper position and a lower position corresponding to the opening and closing, respectively, of orifices 56.

Safety jacket 47 is controlled by a socket 74 designed to cooperate with the bolt of a tool circulating in the casing 3. Upper part 75 of valve body 53 has, at the level of the safety jacket 47, a chamfer 76 matching the clearance of the bolt. Jacket 47 is rotationally positioned with respect to body 53 by a projection 77 integral with the extension 57 and cooperating with a groove 78 provided in safety jacket 47.

The lower end of solenoid valve 45 has a nipple 79 attached to body 53 by a thread 80, with the nipple 79 being provided with male conical connector 55.

In FIG. 2, the solenoid valve 45 is shown as "normally open," i.e. when the pressure of the fluid acting on the hydraulic jacket 46 is less than a given value, the orifices in the valve body 53 are not blocked by the sliding hydraulic jacket 46 because of the return force of the spring 64 which causes the opening stop 58 to cooperate with the upper nipple 59 of the sliding hydraulic jacket 46.

It will be a departure from the invention to use a "normally closed" valve. For this purpose, one need only, for example, elevate the orifices in sliding hydraulic jacket 46 in such a way that, when the opening stop 58 cooperates with the upper nipple 59, the orifices 56 are obstructed at the level of the sliding hydraulic jacket 46 and such that, when the bead 60 of the groove 61 cooperates with the bead 62 of the key 63, the orifices 56 are clear at the level of the sliding hydraulic jacket 46.

The orifices of the solenoid valve 45 are closed by commanding, via the electrical line 48, the opening of the distribution means 51, by creating a suitable pressure in the line 49 to create a fluid flow in a first direction and thus cause the sliding hydraulic jacket 46 to descend.

To immobilize the sliding hydraulic jacket 46 in the positions in which the orifices are open or closed, regardless of the pressure in line 49, the distribution means 51 are closed.

The orifices of the solenoid valve 45 opened by opening the distribution means 51 to place the thrust chamber 52 in communication with the hydraulic line and create a suitable pressure in the line 49 in order to create a flow of fluid in a second direction opposite the first direction and thus elevate the sliding hydraulic jacket 46, the pressure being less than the orifice closing pressure.

Figure 3:
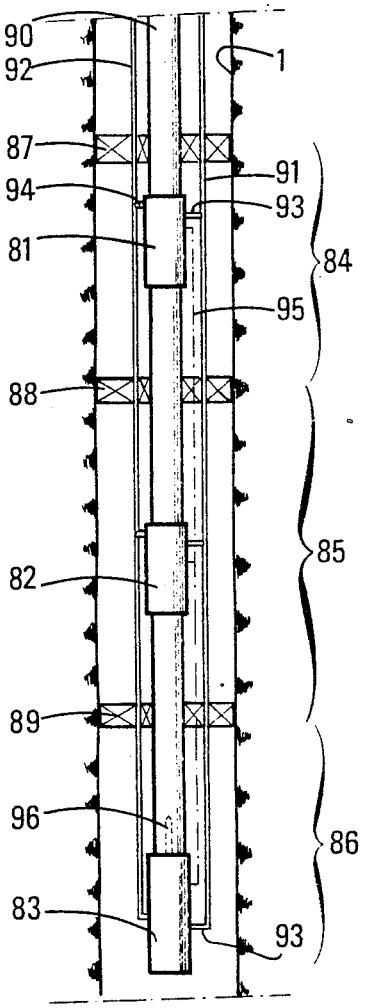
FIG. 3 is a schematic view of a device according to the present invention having hydraulic tools and/or instruments.

As shown in FIG. 3 hydraulic tools and/or instruments 81, 82, 83 of the device are disposed on a casing 90 located in well 1, with the device being designated in particular for selective production from different producing zones such as zones 30, 31, 32, 33 of FIG. 1 or 84, 85, 86 of FIG. 3. These tools and/or instruments, may, for example, be the valves illustrated in FIG. 2. Zones, 84, 85, 86 are respectively delimited by sealing elements 87–88, 88–89, 89 and the bottom of the well 1.

The device has a first hydraulic line 91 and possibly a second hydraulic line 92, with the lines 91, 92 being connected to the tools and/or instruments 81, 82, 83 by branches 93, 94, respectively. Distribution means are disposed on the branches 93 of first hydraulic line 91.

Distribution means of the branches 93 are controlled by an electrical line 95 connected to a first electrical connector 96 disposed at the lower and inner part of the casing 3 and designed to cooperate with a second matching electrical connector connected to the surface of the ground by a transmission cable 22 (FIG. 1). Just as the distribution means are controlled by an electrical line 95, these means may be controlled by hydraulic control lines connected, for example, to a hydraulically controlled connector.

The first hydraulic line 91 and possibly the second hydraulic line 92 are connected to a hydraulic power generator disposed either at the surface of the ground or in the vicinity of the tools and/or instruments 81, 82, 83.

The transmission cable 22 may have an electrical power line enabling a hydraulic power generator located in the vicinity of the tools and/or instruments 81, 82, 83 to be supplied.

The first hydraulic line 91 and possibly the second hydraulic line 92 may be connected to a hydraulic connector disposed inside the casing 3 at its lower part, in the same way as the electrical line 95 is connected to the electrical connector, whereby this hydraulic connector cooperates with a matching element connected to the surface of the ground by a hydraulic line.

These hydraulic and electrical connectors may be combined in one connector, and these hydraulic and electrical lines may be combined into the same line.

In order hydraulically and selectively to control, in two fluid circulation directions, at least two of the tools and/or instruments 81, 82, 83 with the aid of only one hydraulic line, the tools and/or instruments 81, 82, 83 used are provided with return means allowing the tools and/or instruments 81, 82, 83 to revert to an initial position when the pressure has dropped, and the distribution means disposed in branches 93 of first hydraulic line 91 are used with said tools and/or instruments 81, 82, 83.

In order to activate a first tool and/or instrument, the distribution means of the second of the two tools and/or instruments or other tools and/or instruments are closed in order to reduce or even stop fluid circulation in the branch of the second tool and/or instrument, and the distribution means of the first tool and/or instrument are opened in order to increase fluid circulation in the branch of the first tool and/or instrument, and a pressure is created in the first hydraulic line 91 in order to create, and the branch of the first tool and/or instrument, a flow of fluid in a first direction.

When the flow of fluid is to be stopped, as may be necessary to close a valve, the distribution means of the first tool and/or instrument are closed.

To produce a flow in the branch of the first tool and/or instrument in a second direction, opposite the first direction, and in this way manipulate the first tool and/or instrument, the distribution means of the first tool and/or instrument are opened and the pressure in the first hydraulic line is released.

By selectively producing a flow in the branch of a tool and/or instrument, in either direction, it is thus possible to manipulate any type of tool or instrument, especially valves, independently.

In the same way as the first tool and/or instrument has been manipulated, as many tools and/or instruments as desired may be manipulated.

In order to control hydraulically and selectively, in both fluid circulation directions, at least two tools and/or instruments 81, 82, 83 with the aid of two hydraulic lines only, a first hydraulic line 91 having branches 93 is used with the tools and/or instruments, circulation in the branches 93 being controlled by the distribution means located in each of these branches 93, and a second hydraulic line 92 having branches 94 is used with the tools and/or instruments.

To activate a first tool and/or instrument, the distribution means of the second of said two tools and/or instruments are closed in order to reduce or even stop fluid circulation in the branches of the second tool and/or instrument. The distribution means of the first tool and/or instrument are opened to increase fluid circulation in the branch of the first tool and/or instrument, and the pressures able to produce fluid circulation in the branch with the first line, in the first and/or second direction, are created in said first and/or second line.

To allow circulation of fluid in the first or second circulation direction, as may be the case when opening or closing of the solenoid valve 45, a positive or negative pressure differential is created between the first and second hydraulic lines 91, 92.

In the same way as the first tool and/or instrument has been controlled independently of the second, any type of tools and/or instruments may be controlled independently of each other.

I claim:

1. Method for carrying out at least one of operations and manipulations such as measurements in a well having a casing means with a smaller diameter than a diameter of the well, the well being drilled into geological formations and having at least two distinct producing zones, the method comprising the steps of:

equipping each of said at least two producing zones of the well with at least one of an instrument means and tool means for performing said at least one of said operations and manipulations;

equipping said casing means with a first connector means usable in a liquid medium;

connecting the at least one of said instrument means and tool means to said first connector means by line means;

equipping a transmission cable means with a second connector means adapted to be connected to said first connector means;

introducing said transmission cable means into said casing means;

moving said second connector means until said second connector means cooperates with said first connector means; and carrying out said at least one of said operations and manipulations by controlling said at least one of said operations and manipulations by controlling said at least one of said tool means and instrument means by said transmission cable means.

2. Method according to claim 1, wherein said at least one of said tool means and said instrument menas are integral with said casing means.

3. Method according to one of claim 1 or 2, wherein said at least two distinct zones are fluid-producing zones.

4. Method according to claim 3, wherein at least one of said instrument means includes a means for measuring at least one of physical, chemical, and physiochemical characteristics of the fluids present in a producing zone.

5. Method according to claim 3, wherein at least one of said tool means includes means for modifying a fluid flow rate in a producing zone.

6. Method according to claim 5, wherein said first connector means is disposed at a lower end of said casing means.

7. Method according to one of claim 1 or 2, wherein said zones are fluid producing zones, further comprising the steps of working said producing zones by transferring fluid produced in at least one of the fluid producing zones through the interior of the casing means, and equipping said casing means with means for permitting selective production from said well.

8. Method according to claim 7, further comprising the steps of disposing said first connector means at a lower end of the casing means, and locating a pipe means in said well for communicating with the lower end of said casing means by at least one of a hydraulic connector means and a passageway means, said hydraulic connector means and said passageway means being located in a vicinity of said first connector means.

9. Device for conducting at least one of operations and manipulations such as measurements in a well having a casing means which has a smaller diameter than a diameter of the well, the well being drilled into geological formations and having at least two distinct zones, said casing means includes in an interior thereof a first connector means usable in a liquid medium, said first connector means being connected by line means to at least one of an instrument means and tool means disposed in each of the distinct zones, said first connector means being adapted to cooperate with a second connector means connected by a transmission cable means to a surface of the ground, and wherein said casing means is adapted to allow the second connector means to be lowered from the surface and to be connected with the first connector means.

10. Device according to claim 9, wherein said zones are fluid-producing zones, and wherein said casing means is adapted to hold said at least one of said tool means and instrument means.

11. Device according to one of claims 9 or 10, wherein said zones are producing zones, and said casing means includes means for allowing said producing zones to communicate with the interior of said casing means thereby permitting selective production from said well.

12. Device according to claim 11, wherein said first connector means is disposed at a lower end of said casing means.

13. Device according to claim 12, further comprising a pipe means communicating with said casing means essentially at a level of said first connector means and terminating at the surface of the ground.

14. Method according to one of claims 1 or 2, wherein at least one of said instrument means includes a means for measuring at least one of physical, chemical, and physiochemical characteristics of fluids present in a producing zone.

15. Method according to claim 14, wherein at least one of said tool means includes means for modifying a fluid flow rate in a producing zone.

16. Method according to claim 15, wherein said first connector means is disposed at a lower end of said casing means.

17. Method according to claim 16, further comprising steps of disposing said first connector means at a lower end of the casing means, and locating a pipe means in said well for communicating with the lower end of said casing means by at least one of a hydraulic connector means and a passageway means, said hydraulic connector means and said passageway means being located in a vicinity of said first connector means.

18. Method according to one of claims 1 or 2, wherein at least one of said tool means includes means for modifying a fluid flow rate in a producing zone.

19. Method according to one of claims 1 or 2, wherein said first connector means is disposed at a lower end of said casing means.

20. Method according to one of claims 1 or 2, further comprising the steps of disposing said first connector means at a lower end of the casing means, and locating a pipe means in said well for communicating with the lower end of said casing means by at least one of a hydraulic connector means and a passageway means, said hydraulic connector means and said passageway means being located in a vicinity of said first connector means.

21. Device according to one of claims 9 or 10, wherein said first connector means is disposed at a lower end of said casing means.

22. Device according to one of claims 9 or 10, further comprising a pipe means communicating with said casing means essentially at a level of said first connector means and terminating at the surface of the ground.

* * * * *